US011385668B2

(12) United States Patent
Huang et al.

(10) Patent No.: US 11,385,668 B2
(45) Date of Patent: Jul. 12, 2022

(54) CONFIGURABLE OFFSET COMPENSATION DEVICE

(71) Applicant: Realtek Semiconductor Corp., HsinChu (TW)

(72) Inventors: Ting-Yao Huang, HsinChu (TW); Po-Chih Wang, HsinChu (TW); Ka-Un Chan, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 17/234,760

(22) Filed: Apr. 19, 2021

(65) Prior Publication Data

US 2021/0333816 A1 Oct. 28, 2021

(30) Foreign Application Priority Data

Apr. 22, 2020 (TW) ..... 109113491

(51) Int. Cl.
*G05F 3/24* (2006.01)

(52) U.S. Cl.
CPC ..... *G05F 3/242* (2013.01)

(58) Field of Classification Search
CPC ..... G05F 3/242
See application file for complete search history.

(56) References Cited

U.S. PATENT DOCUMENTS 6,970,689 B2 * 11/2005 Khorram ..... H03D 7/1441 327/113
7,076,384 B1 7/2006 Radulov
7,098,738 B2 * 8/2006 Tam ..... H03G 1/0088 330/284
7,289,783 B2 * 10/2007 Rostami ..... H03D 7/1441 327/359
7,697,905 B2 * 4/2010 Lee ..... H04B 1/30 455/114.2
8,335,249 B1 * 12/2012 Su ..... H03F 3/45197 375/232
8,457,190 B2 * 6/2013 Raghavan ..... H04L 25/061 375/233
9,046,908 B2 * 6/2015 Gong ..... G05F 1/46
10,826,570 B2 * 11/2020 Balteanu ..... H04B 7/0413
2007/0042728 A1 * 2/2007 Pan ..... H04B 1/30 455/127.1

OTHER PUBLICATIONS

Office action dated Apr. 21, 2022 for CN application No. 202010355439.1, filing date: Apr. 29, 2020, pp. 1-8.

* cited by examiner

*Primary Examiner* — Thomas J. Hiltunen
(74) *Attorney, Agent, or Firm* — Winston Hsu

(57) ABSTRACT

An offset compensation device includes a first bias module and a second bias module. The first bias module includes a plurality of first current control circuits and a plurality of second current control circuits coupled in parallel. Each of the first current control circuits generates a first reference current, and each of the second current control circuits generates a second reference current. The second bias module includes a plurality of third current control circuits and a plurality of fourth current control circuits coupled in parallel. Each of the third current control circuits generates a third reference current, and each of the fourth current control circuits generates a fourth reference current. The second reference current is greater than the first reference current, and the fourth reference current is greater than the third reference current.

14 Claims, 4 Drawing Sheets

CONFIGURABLE OFFSET COMPENSATION DEVICE

BACKGROUND OF THE INVENTION

1. Field of the Invention

The present invention is related to an offset compensation device, and more particularly to a configurable offset compensation device.

2. Description of the Prior Art

Since the differential signal has a better immunity against ambient noises, it is widely adopted in various circuits. However, in the actual manufacturing of differential amplifiers or other types of differential circuits, due to process deviations, the direct current (DC) voltage level is often shifted unexpectedly, causing offset voltages and/or offset currents at the terminals of the differential pair. Since the offset voltage and/or offset current at the terminals of the differential pair will interfere with the differential signal and cause distortion, additional voltage or current must be applied to compensate the offset and reduce the impact brought by the shift of the DC voltage level.

Furthermore, as the manufacturing technology grows, the size of electronic components becomes smaller and smaller. However, when the size of the electronic component becomes smaller, the influence of the same offset voltage and/or offset current on the differential circuit will also become more significant, and thus, the requirements for accurate compensation to the offset voltage and/or the offset current would be higher.

SUMMARY OF THE INVENTION

One embodiment of the present invention discloses an offset compensation device. The offset compensation device includes a first bias module and a second bias module.

The first bias module is coupled to a first bias node and includes a plurality of first current control circuits and a plurality of second current control circuits. Each of the plurality of first current control circuits generates a first reference current, and each of the plurality of second current control circuits generates a second reference current. The second bias module is coupled to a second bias node and includes a plurality of third current control circuits and a plurality of fourth current control circuits. Each of the plurality of third current control circuits generates a third reference current, and each of the plurality of fourth current control circuits generates a fourth reference current.

The plurality of first current control circuits and the plurality of second current control circuits are coupled in parallel and coupled to the first bias node. The plurality of third current control circuits and the plurality of fourth current control circuits are coupled in parallel and coupled to the second bias node. The second reference current is greater than the first reference current, and the fourth reference current is greater than the third reference current.

Another embodiment of the present invention discloses a method for operating an offset compensation device. The offset compensation device includes a first bias module and a second bias module. The first bias module includes a plurality of first current control circuits and a plurality of second current control circuits. The second bias module includes a plurality of third current control circuits and a plurality of fourth current control circuits. The plurality of first current control circuits and the plurality of second current control circuits are coupled in parallel and coupled to a first bias node, and the plurality of third current control circuits and the plurality of fourth current control circuits are coupled in parallel and coupled to a second bias node.

The method includes enabling a first number of second or fourth current control circuits according to an offset value for making a preliminary compensation to the offset value, and enabling a second number of first or third current control circuits according to the offset value after the preliminary compensation is made for making a further compensation to the offset value.

A second reference current generated by each of the second current control circuits is greater than a first reference current generated by each of the first current control circuits, and a fourth reference current generated by each of the fourth current control circuits is greater than a third reference current generated by each of the third current control circuits.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
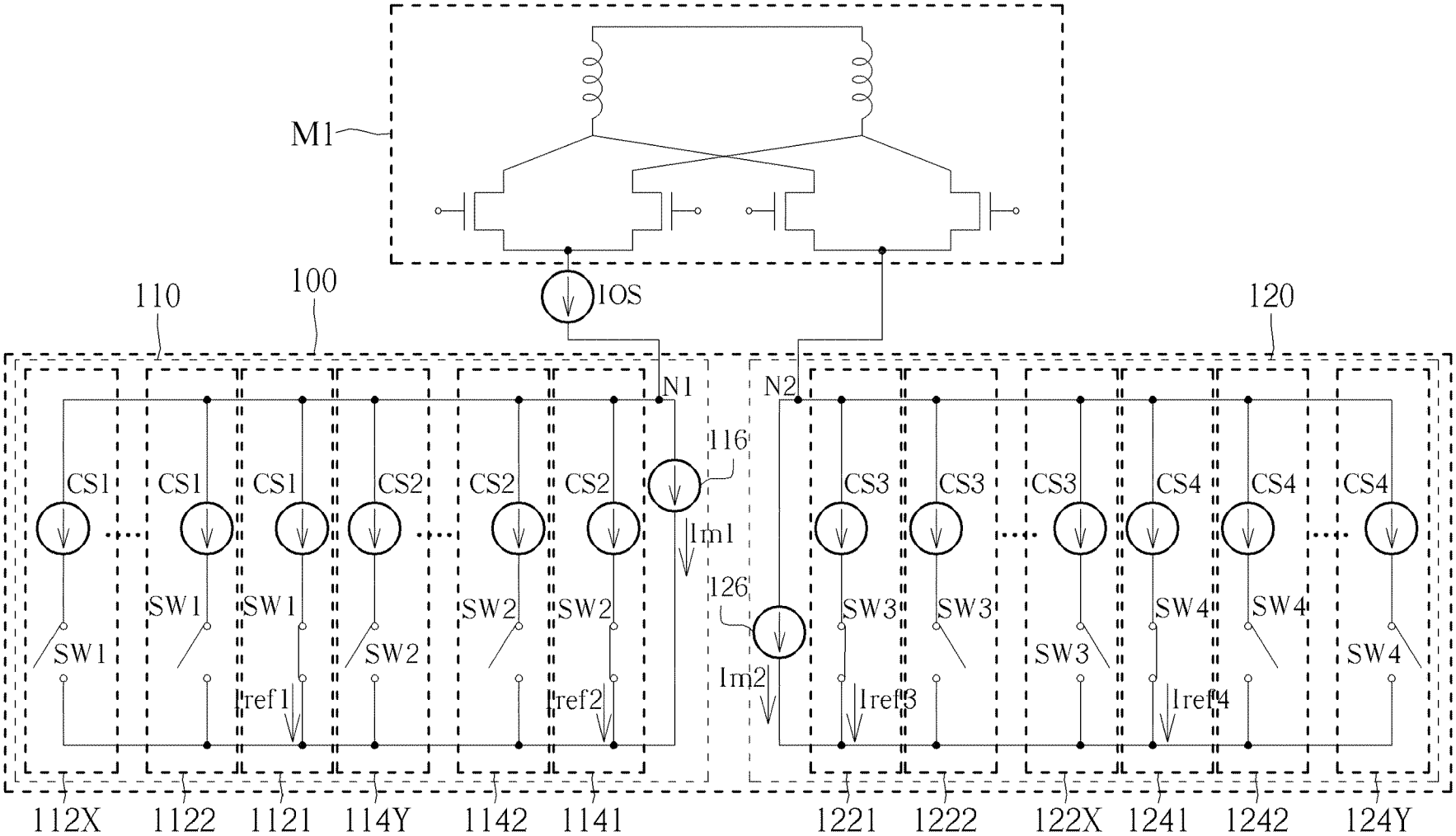
FIG. 1 shows an offset compensation device according to one embodiment of the present invention.

FIG. 1 shows an offset compensation device 100 according to one embodiment of the present invention. In FIG. 1, the offset compensation device 100 can be used to compensate the offset current IOS between the two differential current terminals of a mixer M1. The offset compensation device 100 includes a first bias module 110 and a second bias module 120. The first bias module 110 can be coupled to a first bias node N1, and the second bias module 120 can be coupled to a second bias node N2.

The first bias module 110 can include first current control circuits 1121 to 112X and second current control circuits 1141 to 114Y, where X and Y are positive integers. Each of the first current control circuits 1121 to 112X can generate a first reference current Iref1, and each of the second current control circuits 1141 to 114Y can generate a second reference current Iref2. The second bias module 120 can include third current control circuits 1221 to 122X and fourth current control circuits 1241 to 124Y. Each of the third current control circuits 1221 to 122X can generate a third reference current Iref3, and each of the fourth current control circuits 1241 to 124Y can generate a fourth reference current Iref4.

In the first bias module 110, the first current control circuits 1121 to 112X and the second current control circuits 1141 to 114Y can be coupled to the first bias node N1 and can be coupled in parallel. In the second bias module 120, the third current control circuits 1221 to 122X and the fourth current control circuits 1241 to 124Y can be coupled to the second bias node N2 and can be coupled in parallel.

In FIG. 1, the first current control circuit 1121 can include a reference current source CS1 and a switch SW1. The reference current source CS1 can generate the first reference current Iref1, and the switch SW1 can be coupled in series with the reference current source CS1. In some embodiments, the switch SW1 can be turned on to enable the first reference current source CS1 and can be turned off to disable the first reference current source CS1. In some embodiments, the first current control circuits 1121 to 112X, the second current control circuits 1141 to 114Y, the third current control circuits 1221 to 122X, and the fourth current control circuits 1241 to 124Y can have the similar structures. That is, the offset compensation device 100 can control the switches SW1 in the first current control circuits 1121 to 112X, the switches SW2 in the second current control circuits 1141 to 114Y, the switches SW3 in the third current control circuits 1221 to 122X, and the switches SW4 in the fourth current control circuits 1241 to 124Y to enable or disable the reference current sources CS1, CS2, CS3, and CS4. Therefore, each of the first current control circuits 1121 to 112X, the second current control circuits 1141 to 114Y, the third current control circuits 1221 to 122X, and the fourth current control circuits 1241 to 124Y can be controlled independently.

Furthermore, in the present embodiment, the second reference current Iref2 generated by the reference current source CS2 can be greater than the first reference current Iref1 generated by the reference current source CS1, and the fourth reference current Iref4 generated by the reference current source CS4 can be greater than the third reference current Iref3 generated by the reference current source CS3. In addition, the first reference current Iref1 can be equal to the third reference current Iref3, and the second reference current Iref2 can be equal to the fourth reference current Iref4.

Furthermore, in FIG. 1, the first bias module 110 can further include a first primary current source 116. The first primary current source 116 can be coupled in parallel with the first current control circuits 1121 to 112X and the second current control circuits 1141 to 114Y, and the first primary current source 116 can generate a first primary current Im1. Similarly, the second bias module 120 can further include a second primary current source 126. The second primary current source 126 can be coupled in parallel with the third current control circuits 1221 to 122X and the fourth current control circuits 1241 to 124Y, and the second primary current source 126 can generate a second primary current Im2. The first primary current source 116 and the second primary current source 126 can be used to provide the default bias currents according to the system requirement even when the first current control circuits 1121 to 112X, the second current control circuits 1141 to 114Y, the third current control circuits 1221 to 122X, and the fourth current control circuits 1241 to 124Y are disabled. In some embodiments, the first primary current Im1 can be equal to the second primary current Im2.

In some embodiments, the offset compensation device 100 can enable a proper number of second current control circuits 1141 to 114Y or a proper number of fourth current control circuits 1241 to 124Y according to the offset value to be compensated, that is, the offset IOS in the present embodiment. After the number of second current control circuits 1141 to 114Y or the number of fourth current control circuits 1241 to 124Y to be enabled is determined to make a preliminary compensation, according to the result of the preliminary compensation, the number of first current control circuits 1121 to 112X or the number of third current control circuits 1221 to 122X to be enabled can be determined to make a further compensation to the offset current IOS.

Since the offset compensation device 100 can use the second current control circuits 1141 to 114Y or the fourth current control circuits 1241 to 124Y to generate greater currents for making a preliminary compensation, and can use first current control circuits 1121 to 112X or the third current control circuits 1221 to 122X to generate smaller current for making a further compensation, the offset compensation device 100 can determine the numbers of current control circuits to be enabled for achieving the desired compensation result rapidly. Furthermore, by adopting this kind of configurable compensation structure, the offset compensation device 100 can reduce the total number of the current control circuits and, thus, the offset compensation device 100 can be implemented within a smaller circuit area.

Figure 2:
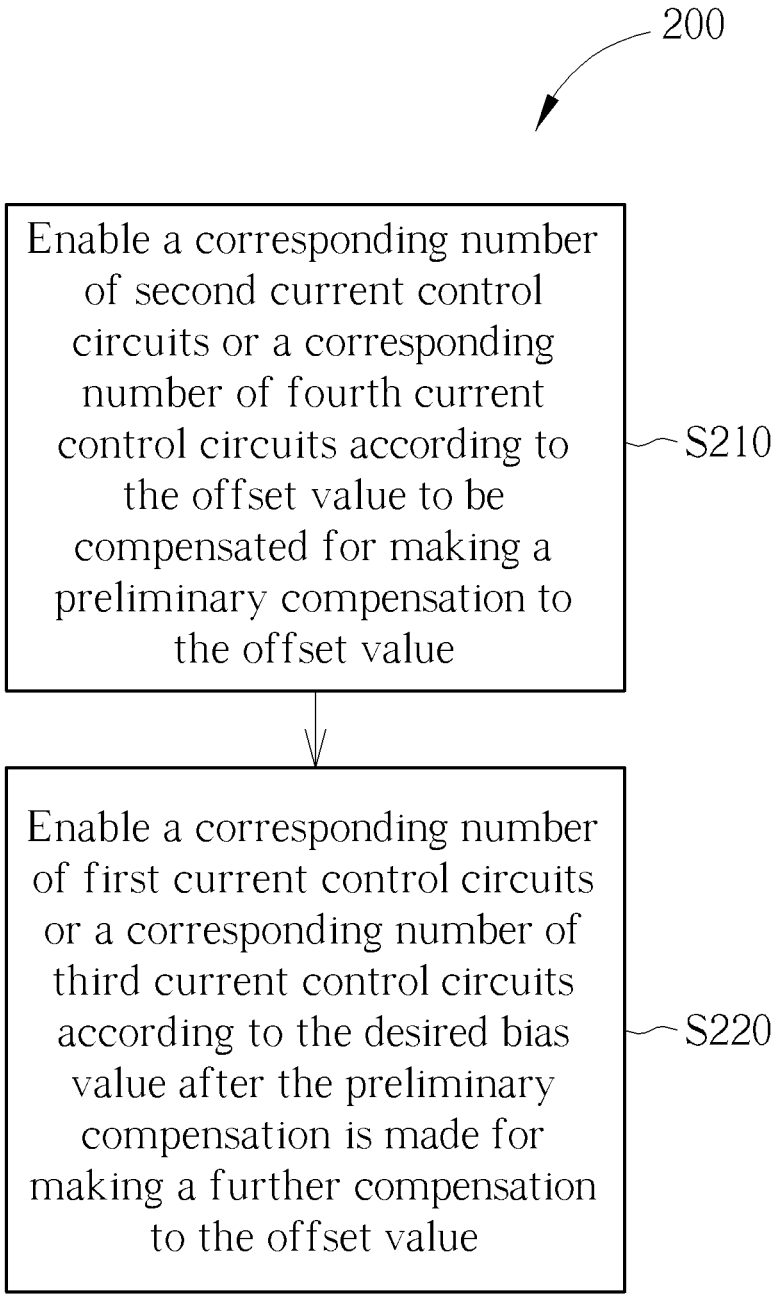
FIG. 2 shows a flowchart of a method for operating the offset compensation device in FIG. 1 according to one embodiment of the present invention.

FIG. 2 shows a flowchart of a method 200 for operating the offset compensation device 100 according to one embodiment of the present invention. The method 200 includes steps S210 and S220.

S210: enable a corresponding number of second current control circuits 1141 to 114Y or a corresponding number of fourth current control circuits 1241 to 124Y according to the offset value to be compensated for making a preliminary compensation to the offset value; and S220: enable a corresponding number of first current control circuits 1121 to 112X or a corresponding number of third current control circuits 1221 to 122X according to the desired bias value after the preliminary compensation is made for making a further compensation to the offset value.

Generally, the actual value of the offset current IOS is unknown before the offset current IOS is compensated. However, the value of the offset current can be roughly depicted by observing the offset current and/or the local oscillator (LO) leakage generated by the mixer M1 under the original DC level condition.

In addition, according to the direction of the leakage current, the user can determine to increase the current at the first bias node N1 by enabling the second current control circuits 1141 to 114Y or to increase the current at the second bias node N2 by enabling the fourth current control circuits 1241 to 124Y for compensation. For the mixer M1, the current on the first node N1 and the current on the second node N2 are counterparts to each other. That is, increasing the current on the first bias node N1 has the same effect as decreasing the current on the second bias node N2. Similarly, increasing the current on the second bias node N2 has the same effect as decreasing the current on the first bias node N1. Therefore, in general, when any of the second current control circuits 1141 to 114Y is determined to be enabled, all the fourth current control circuits 1241 to 124Y may be disabled, avoiding the second reference current Iref2 and the fourth reference current Iref4 from canceling each other. Similarly, when any of the fourth current control circuits 1241 to 124Y is determined to be enabled, all the second current control circuits 1141 to 114Y may be disabled.

In step S210, after determining whether to enable the second current control circuits 1141 to 114Y or the fourth current control circuits 1241 to 124Y, the corresponding number of the second current control circuit 1141 to 114Y or the corresponding number of the fourth current control circuit 1241 to 124Y that should be enabled can be further determined. In some embodiments, the offset compensation device 100 can gradually increase the number of enabled second current control circuits 1141 to 114Y to increase the current on the first bias node N1 or gradually increase the number of enabled fourth current control circuits 1241 to 124Y to increase the current on the second bias node N2 for seeking the proper configurations of the current control circuits that can minimize the LO leakage.

Figure 3:
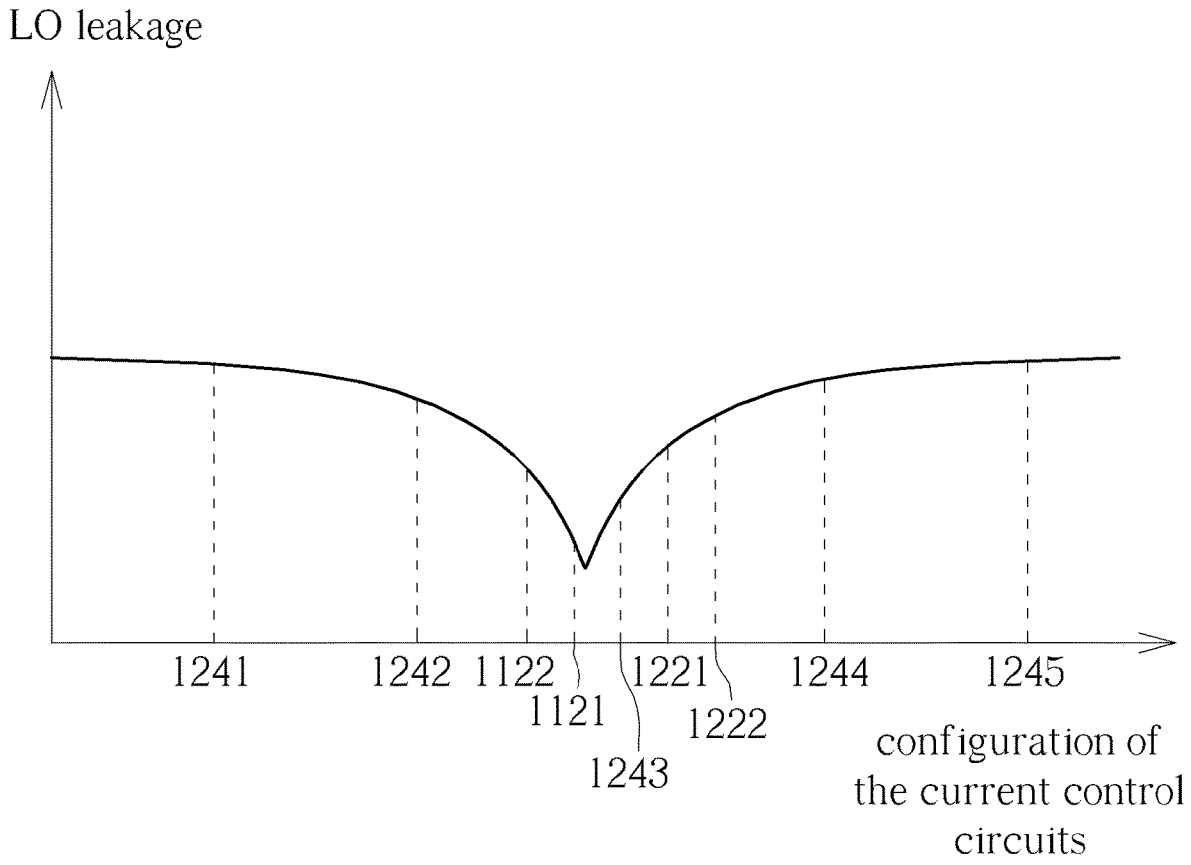
FIG. 3 shows the relationship between the LO leakage of the mixer and the configuration of the current control circuits of the offset compensation device in FIG. 1 according to one embodiment of the present invention.

FIG. 3 shows the relationship between the LO leakage of the mixer M1 and the configuration of the current control circuits of the offset compensation device 100 according to one embodiment of the present invention. In FIG. 3, the actual value of the offset current IOS can be, for example, 280 μA, and the fourth reference current Iref4 generated by each of the fourth current control circuits 1241 to 124Y can be 100 μA. In this case, when the offset compensation device 100 gradually enables the fourth current control circuits 1241 to 1243, part of the reference currents Iref4 generated by the fourth current control circuits 1241 to 1243 will cancel out the offset current IOS. Therefore, the value of LO leakage will gradually decrease. However, when the offset compensation device 100 enables the fourth current control circuits 1241 to 1244, it will over-compensate, which will increase the value of the LO leakage. In this case, the offset compensation device 100 can select to enable only three of the fourth current control circuits 1241 to 1243 as the most appropriate configuration in step S210 to perform the preliminary compensation to the offset current IOS.

In step S220, the similar principle can be followed. That is, the offset compensation device 100 can gradually increase the number of enabled first current control circuits to increase the current on the first bias node N1 or gradually increase the number of enabled third current control circuits to increase the current on the second bias node N2 for making further compensation.

For the mixer M1, since the current on the first node N1 and the current on the current on the second node N2 are counterparts to each other. Therefore, when any of the first current control circuits 1121 to 112X is determined to be enabled, all the third current control circuits 1221 to 122X may be disabled, avoiding the first reference current Iref1 and the third reference current Iref3 from canceling each other. Similarly, when any of the third current control circuits 1221 to 122X is determined to be enabled, all the first current control circuits 1121 to 112X may be disabled.

In FIG. 3, the first reference current Iref1 and the third reference current Iref3 can be 25 μA. In this case, when there are more third current control circuits 1221 to 122X being enabled, the LO leakage of the mixer M1 will also increase. However, when the first current control circuit 1121 is enabled, the LO leakage of the mixer M1 will have a minimal value, and the LO leakage of the mixer M1 will increase when the first current control circuit 1122 is also enabled. In this case, the offset compensation device 100 can determine to enable the first current control circuit 1121 to complete the compensation for the offset current IOS in step S220.

Since the offset compensation device 100 can use the current control circuits that generate greater currents to make a preliminary compensation, and can use the current control circuits that generate smaller currents to make a further compensation according to the result of the preliminary compensation, the offset compensation device 100 can determine which current control circuits to be enabled and the numbers of enabled current control circuits rapidly to make the compensation. By adopting such configurable compensation structure, the offset compensation device 100 can reduce the total number of current control circuits and, thus, compensation can be completed within a smaller circuit area.

For example, if the system requires the offset compensation device 100 to provide 32 levels of different compensation currents, then X can be 7 and Y can be 3. In this case, the first bias module 110 and the second bias module 120 can each include 10 current control circuits. However, in prior art, if the reference currents generated by the current control circuits are all the same, each bias module would need 31 current control circuits for providing the 32 levels of different compensation currents. In contrast, the offset compensation device 100 can not only reduce the area, but also reduce the parasitic effects and maintain the compensation effect.

In the offset compensation device 100, the first bias module 110 and the second bias module 120 can each include two different current control circuits for generating reference currents of different intensities. Therefore, the compensation can be achieved in two stages. However, in some other embodiments, according to the system requirement, the offset compensation device may include more different current control circuits for generating reference currents of different intensities and achieve the compensation with more stages.

Furthermore, due to the uncontrollable factors in the manufacturing process, the first reference currents Iref1 generated by the first current control circuits 1121 to 112X may not be completely equal. In this case, to ensure that the current can be increased smoothly when the number of enabled current control circuits increases, the first current control circuits 1121 to 112X can have the same layout so that the variation of the reference current Iref1 can be reduced. Also, the first current control circuits 1121 to 112X can be enabled according to a fixed order so as to prevent that the current is not positively correlated to the number of enabled current control circuits when the enabled current control circuits are unfortunately the ones that generate smaller reference currents Iref1. Similarly, the other current control circuits can be operated with the same principle to reduce the current variation to influence the compensation result.

Furthermore, since the second reference currents Iref2 generated by the second current control circuits 1141 to 114Y may also be slightly different, the first bias module 110 may include more first current control circuits 1121 to 112X so the total current generated by the first reference currents Iref1 outputted by the first current control circuits 1121 to 112X can be greater than the target value of the second reference current Iref2. For example, if the second reference current Iref2 is targeted to be 100 μA and the first reference current Iref1 is targeted to be 25 μA, then the first bias module 110 can include 5 first current control circuits 1121 to 1125, that is, X can be 5. Consequently, when the second reference current Iref2 generated by the second current control circuit 1141 is smaller than the target value, such as 75 μA, then the first bias module 110 can still provide a 200 μA current by enabling the second current control circuit 1141 and the five first current control circuits 1121 to 1125, ensuring the current accuracy of each compensation stage. Similarly, the second bias module 120 can include more third current control circuits 1221 to 122X so that the total current generated by the third reference currents Iref3 outputted by the third current control circuits 1221 to 122X can be greater than the target value of the fourth reference current Iref4.

In FIG. 1, the number X of the first current control circuits 1121 to 112X can be the same as the number X of the third current control circuits 1221 to 122X, and the number Y of the second current control circuits 1141 to 114Y can be the same as the number Y of the fourth current control circuits 1241 to 124Y. However, in some embodiments, according to the system requirements, the number of the first current control circuits can be different from the number of the third current control circuits. Also, the number of the second current control circuits can be different from the number of the fourth current control circuits.

Figure 4:
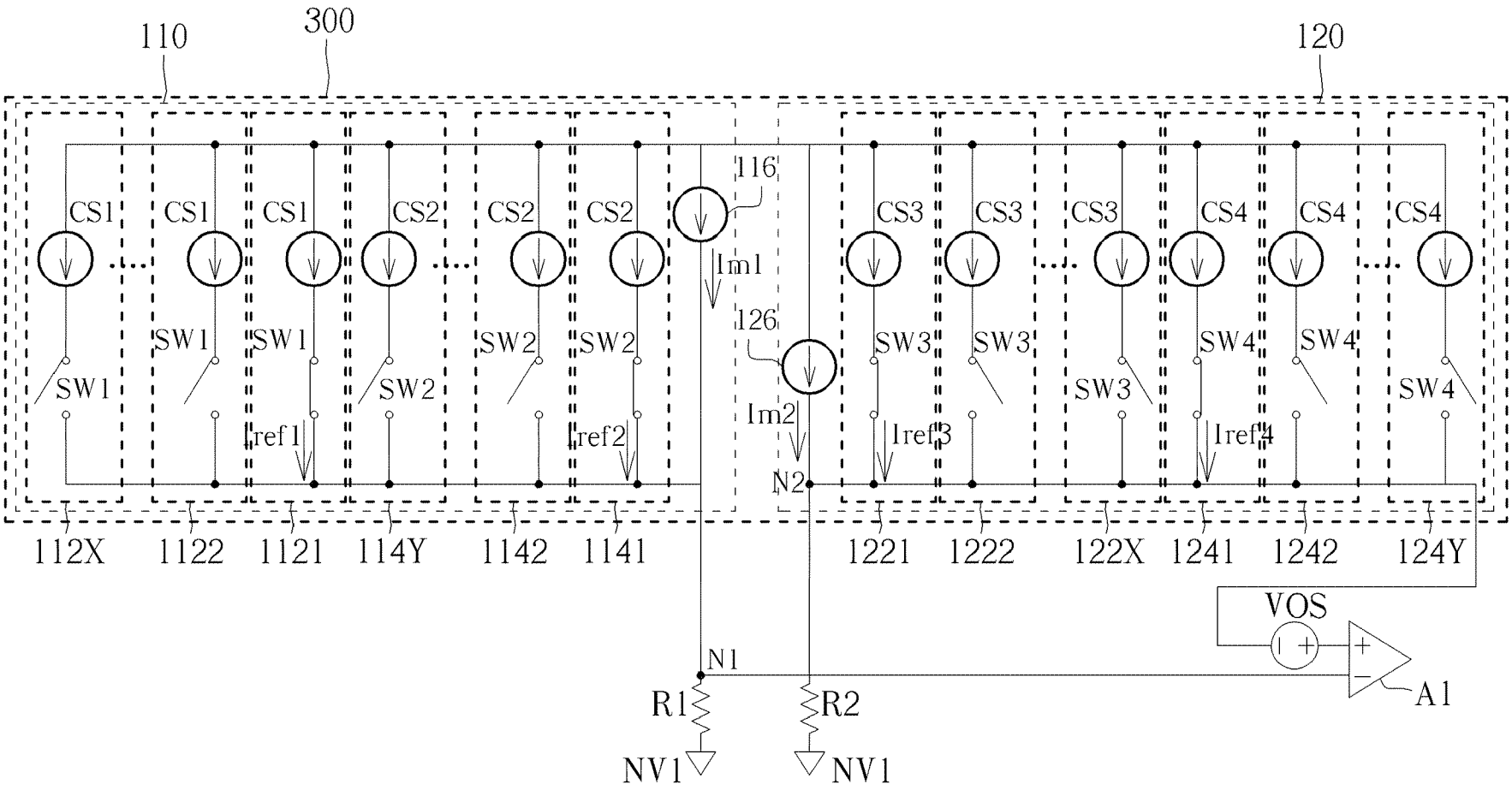
FIG. 4 shows another offset compensation device according to another embodiment.

FIG. 4 shows another offset compensation device 300 according to another embodiment. The offset compensation device 300 and the offset compensation device 100 can have similar structures, and can be operated by similar principles. However, the offset compensation device 300 can further include resistors R1 and R2.

The resistor R1 has a first terminal coupled to the first bias node N1, and a second terminal coupled to a system voltage terminal NV1. The resistor R2 has a first terminal coupled to the second bias node N2, and a second terminal coupled to the system voltage terminal NV1. In this case, by adjusting the currents outputted by the first bias module 110 and the second bias module 120, the voltages at the terminals of the resistors R1 and R2 can also be adjusted, thereby adjusting the voltages at the bias nodes N1 and N2. Consequently, the offset compensation device 300 can be used to compensate the offset voltage VOS at the input terminals of the differential amplifier A1. In some embodiments, the method 200 can also be used to operate the offset compensation device 300 to compensate the offset voltage VOS.

In summary, the offset compensation devices and the methods for operating the offset compensation devices provided by the embodiments of the present invention can compensate the offset current or the offset voltage in multiple stages so that the compensation can be made rapidly while the number of current control circuits can be reduced, thereby reducing the circuit area and the parasitic effects.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An offset compensation device comprising:

a first bias module coupled to a first bias node and comprising:

a plurality of first current control circuits each configured to generate a first reference current; and a plurality of second current control circuits each configured to generate a second reference current; and a second bias module coupled to a second bias node and comprising:

a plurality of third current control circuits each configured to generate a third reference current; and a plurality of fourth current control circuits each configured to generate a fourth reference current;

wherein:

the plurality of first current control circuits and the plurality of second current control circuits are coupled in parallel and coupled to the first bias node;

the plurality of third current control circuits and the plurality of fourth current control circuits are coupled in parallel and coupled to the second bias node;

the second reference current is greater than the first reference current, and the fourth reference current is greater than the third reference current;

when a second current control circuit of the plurality of second current control circuits is enabled, the plurality of fourth current control circuits are disabled; and when a fourth current control circuit of the plurality of fourth current control circuits is enabled, the plurality of second current control circuits are disabled.

2. The offset compensation device of claim 1, wherein the first reference current is equal to the third reference current, and the second reference current is equal to the fourth current.

3. The offset compensation device of claim 1, wherein a total number of first current control circuits is equal to a total number of third current control circuits, and a total number of second current control circuits is equal to a total number of fourth current control circuits.

4. The offset compensation device of claim 1, wherein a total current of a plurality of first reference currents outputted by the plurality of first current control circuits is greater than the second reference current.

5. The offset compensation device of claim 1, wherein:

the first bias module further comprises a first primary current source coupled in parallel with the plurality of first current control circuits and the plurality of second current control circuits, the first primary current source being configured to generate a first primary current;

the second bias module further comprises a second primary current source coupled in parallel with the plurality of third current control circuits and the plurality of fourth current control circuits, the second primary current source being configured to generate a second primary current; and the first primary current is equal to the second primary current.

6. The offset compensation device of claim 1, wherein:

when a first current control circuit of the plurality of first current control circuits is enabled, the plurality of third current control circuits are disabled; and when a third current control circuit of the plurality of third current control circuits is enabled, the plurality of first current control circuits are disabled.

7. The offset compensation device of claim 1, wherein each of the first current control circuits comprises:

a first reference current source configured to generate the first reference current; and a first switch coupled in series with the first reference current source, and configured to be turned on for enabling the first current control circuit or to be turned off for disabling the first current control circuit.

8. The offset compensation device of claim 1 further comprising:

a first resistor having a first terminal coupled to the first bias node, and a second terminal coupled to a system voltage terminal; and a second resistor having a first terminal coupled to the second bias node, and a second terminal coupled to the system voltage terminal.

9. A method for operating an offset compensation device, the offset compensation device comprising a first bias module and a second bias module, the first bias module comprising a plurality of first current control circuits and a plurality of second current control circuits, the second bias module comprising a plurality of third current control circuits and a plurality of fourth current control circuits, the plurality of first current control circuits and the plurality of second current control circuits being coupled in parallel and coupled to a first bias node, and the plurality of third current control circuits and the plurality of fourth current control circuits being coupled in parallel and coupled to a second bias node, and the method comprising:

enabling a first number of second current control circuits or the first number of fourth current control circuits according to an offset value for making a preliminary compensation to the offset value; and enabling a second number of first current control circuits or the second number of third current control circuits according to the offset value after the preliminary compensation is made for making a further compensation to the offset value;

wherein:

a second reference current generated by each of the second current control circuits is greater than a first reference current generated by each of the first current control circuits, and a fourth reference current generated by each of the fourth current control circuits is greater than a third reference current generated by each of the third current control circuits;

when a second current control circuit of the plurality of second current control circuits is enabled, the plurality of fourth current control circuits are disabled; and when a fourth current control circuit of the plurality of fourth current control circuits is enabled, the plurality of second current control circuits are disabled.

10. The method of claim 9, wherein the first reference current is equal to the third reference current, and the second reference current is equal to the fourth current.

11. The method of claim 9, wherein a total number of first current control circuits is equal to a total number of third current control circuits, and a total number of second current control circuits is equal to a total number of fourth current control circuits.

12. The method of claim 9, wherein a total current of a plurality of first reference currents outputted by the plurality of first current control circuits is greater than the second reference current.

13. The method of claim 9, wherein:

the first bias module further comprises a first primary current source coupled in parallel with the plurality of first current control circuits and the plurality of second current control circuits, and the second bias module further comprises a second primary current source coupled in parallel with the plurality of third current control circuits and the plurality of fourth current control circuits; and the method further comprises:

the first primary current source generating a first primary current; and the second primary current source generating a second primary current equal to the first primary current.

14. The method of claim 9, wherein:

when a first current control circuit of the plurality of first current control circuits is enabled, the plurality of third current control circuits are disabled; and when a third current control circuit of the plurality of third current control circuits is enabled, the plurality of first current control circuits are disabled.

* * * * *